US012667176B1

(12) United States Patent
Silva

(10) Patent No.: US 12,667,176 B1
(45) Date of Patent: Jun. 30, 2026

(54) QUICK RELEASE HAIR TIE

(71) Applicant: David Silva, Reno, NV (US)

(72) Inventor: David Silva, Reno, NV (US)

( * ) Notice: Subject to any disclaimer, the term of this patent is extended or adjusted under 35 U.S.C. 154(b) by 111 days.

(21) Appl. No.: 18/412,832

(22) Filed: Jan. 15, 2024

Related U.S. Application Data

(60) Provisional application No. 63/480,092, filed on Jan. 16, 2023.

(51) Int. Cl.
*A45D 8/34* (2006.01)

(52) U.S. Cl.
CPC ..... *A45D 8/34* (2013.01)

(58) Field of Classification Search
CPC ... A45D 8/00; A45D 8/12; A45D 8/14; A45D 8/16; A45D 8/34; F16G 11/101
USPC ..... D28/41
See application file for complete search history.

(56) References Cited

U.S. PATENT DOCUMENTS 5,913,319 A * 6/1999 Tsai ..... A45D 8/34 132/273
6,327,751 B1 * 12/2001 Ikeda ..... F16G 11/101 24/136 L
D844,241 S * 3/2019 Milkowski ..... D28/41
2005/0109361 A1 * 5/2005 Klug ..... A45D 8/34 132/275
2012/0260935 A1 * 10/2012 Lalonde ..... A45D 8/24 132/273
2013/0167866 A1 * 7/2013 Wright ..... A45D 8/34 132/273
2014/0261521 A1 * 9/2014 Reed, III ..... A45D 8/36 132/273
2015/0027479 A1 * 1/2015 Lei ..... A45D 8/34 132/273
2015/0223530 A1 * 8/2015 Grieco ..... A41D 20/00 2/209.3
2019/0200601 A1 * 7/2019 Assemi ..... A01K 13/00
2020/0383450 A1 * 12/2020 Nelson ..... A45D 8/34
2024/0081504 A1 * 3/2024 Evans ..... A45D 8/34

FOREIGN PATENT DOCUMENTS

WO WO-9738243 A1 * 10/1997 ..... F16G 11/101

* cited by examiner

*Primary Examiner* — Rachel R Steitz
*Assistant Examiner* — Karim Asqiriba

(57) ABSTRACT

A quick-release hair tie comprising a length of elastic with a spring-loaded cord-lock integrally attached to one end of the elastic. The elastic has a nub at the other free end. The nub is removably attached to the cord-lock, creating a loop, by pressing the button of the cord-lock, placing the nub in the cord-lock opening and releasing the cord-lock button to secure the nub within the cord-lock chamber, creating a looped hair tie. The tie can be secured around and around a ponytail as one would do with a traditional looped ponytail hair tie. However, when the user is ready to release the tie from the hair, they simply press the button and the knot or nub automatically releases from the cord-lock, which releases the hair tie without having to pull or tug it out of the hair.

1 Claim, 2 Drawing Sheets

QUICK RELEASE HAIR TIE

BACKGROUND OF THE INVENTION

1. Field of the Invention

The present invention and method relates to a hair styling device. More particularly, to a hair tie with a quick-release cord-lock.

2. Description of Prior Art

Many people like to put their hair up with a ponytail tie. Most work well, however, it is difficult to remove them without tugging or tearing the hair. They often get caught in the hair making them difficult to remove. Traditionally, cord-locks are used by placing a cord into its opening and out the opening on the other side. This is so the cord-lock can snuggly slide up and down a cord to secure the cord around various objects or to cinch them.

SUMMARY OF THE PRESENT INVENTION

An object of the present invention is to provide a hair tie that is convenient, practical, and inexpensive for use in hair styling.

A further object is to provide an instrument that will easily hold hair in place quickly and easily.

A further object is to provide an instrument that will automatically release a hair tie from a ponytail with a simple push of a button.

A further object is to provide an instrument that will hold a ponytail tightly without causing breakage when removing by not having to tug, pull, or rip it out of the hair.

A further object is to provide an instrument that can be reused repeatedly.

A further object is to provide a quick-release hair tie that reattaches into a loop by simply pushing a button, inserting the ties nubbed free end, and releasing the button.

According to one aspect of the present invention, there is provided a length of elastic with a spring-loaded cord-lock integrally attached to one end of the elastic. The elastic has a knot or similar nub at the other free end. The knot or nub is removably attached inside the cord-lock, creating a loop, by pressing the button of the cord-lock, placing the knot or nub in the cord-lock opening and releasing the cord-lock button to secure the knot or nub completely within the cord-lock chamber. The edge of the cord-lock bead opening along with the button pushing the nub or knot upward into the bead chamber, keeps the nub or knot from coming out of it, holding it in place. When the cord-lock button is pressed the nub or knot is released from inside the cord-lock. The knot or nub can't be released from the cord-lock until the button is pressed.

According to the arrangement described above, the tie can be secured around and around a ponytail as done with a traditional looped ponytail hair tie. However, when the user is ready to release the tie from the hair, they simply press the button and the knot or nub automatically releases from the cord-lock, which releases the hair tie without having to pull or tug it out of the hair.

Accordingly, a preferred embodiment, the tie fabric is any type of elastic, and the attached cord-lock is plastic and spring-loaded.

Other objects features and advantages of the present invention will become apparent from the following description of the preferred embodiments given with reference to the accompanying drawings.

BRIEF DESCRIPTION OF THE DRAWINGS

In the accompanying drawings

PREFERRED EMBODIMENTS

Figure 1:
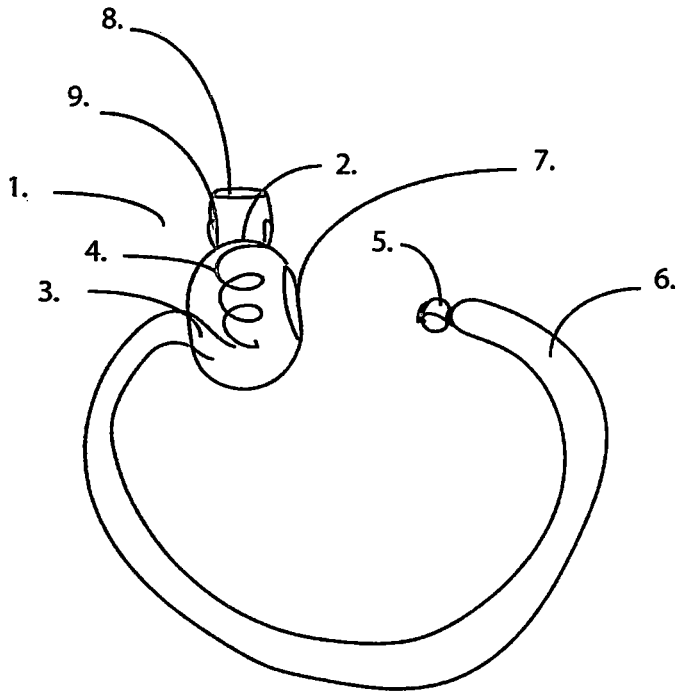
FIG. 1 is a plan view showing the hair tie with quick-release cord-lock with the knot or nub of the elastic unattached from the cord-lock.
Figure 2:
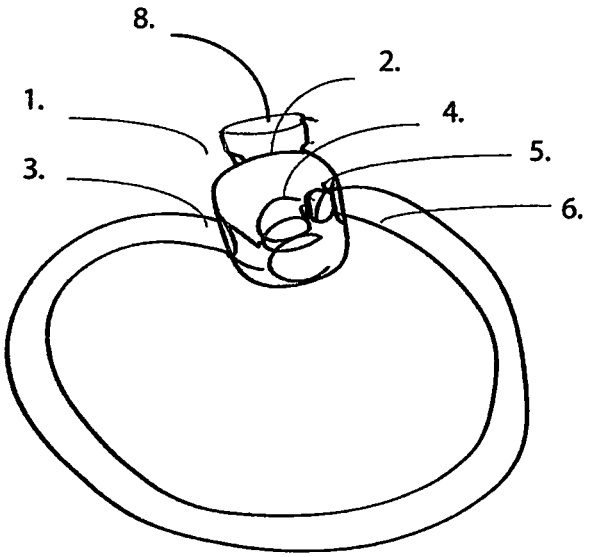
FIG. 2 is a plan view showing the hair tie with quick-release cord-lock with the knot or nub of the elastic attached to the cord-lock.

Referring to FIG. 1 and FIG. 2 of the accompanying drawings, there is illustrated the hair tie with quick-release cord-lock, generally designated by reference numeral 1, embodying the present invention. The hair tie with quick-release cord-lock 1 comprises a length of elastic 6 with a nub or knot 5 and a spring-loaded cord-lock 2. The cord-lock 2 has a spring 4 within it, an opening 7, and a button 8. The button 8 has a hole 9. The elastic 6 is integrally attached to the cord-lock 3.

Figure 3:
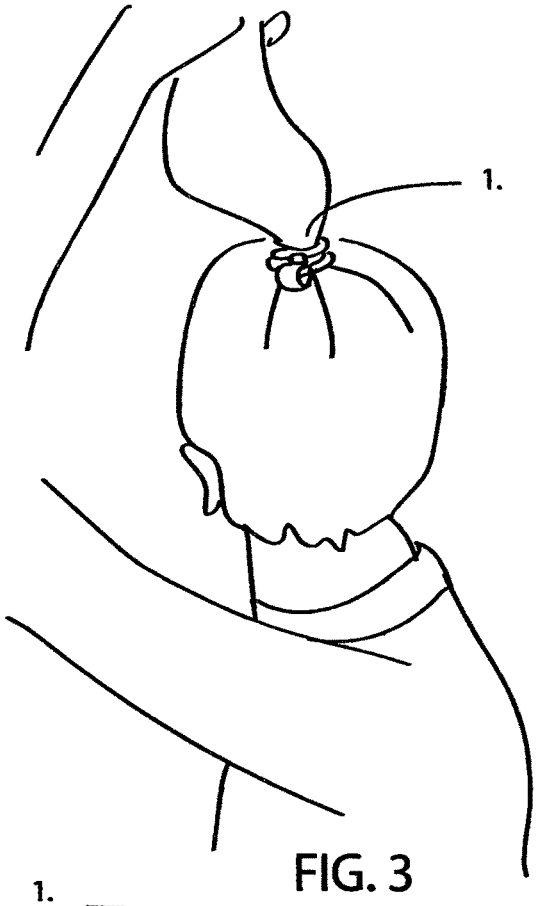
FIG. 3 is a schematic view with the cord-lock attached.
Figure 4:
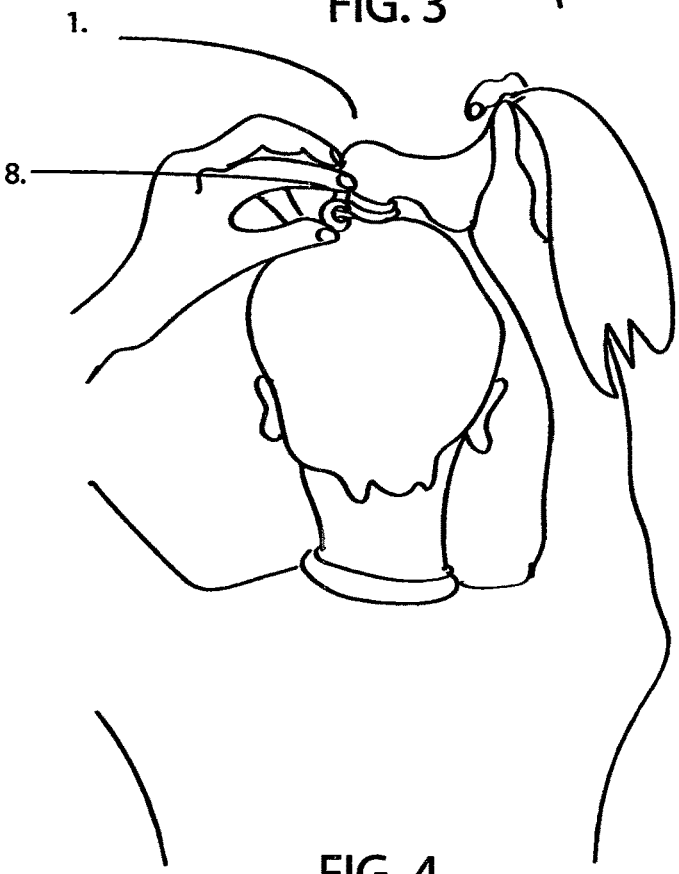
FIG. 4 is a schematic view showing the button being pressed to release the tie.

FIG. 3 shows the hair tie 1 secured to a ponytail. FIG. 4 shows the hair tie 1 being automatically released by pushing button 8.

The present invention being thus described, the same may be varied in many ways. For instance, the cord-lock could be various shapes. The elastic can be various types of non-elastic cord. It can also be used for securing/binding other objects besides hair.

The invention claimed is:

1. A quick-release cord-lock hair tie, the hair tie consisting of:

a length of an elastic cord having a distal end opposite to a proximal end, with a spring-loaded cord-lock integrally attached to the proximal end of the elastic cord and a nub is attached to the distal end of the cord;

said nub is removably attached to the spring-loaded cord-lock;

the spring-loaded cord-lock consisting of three parts: a bead with a hole therethrough and an opening at its top, a toggle with a hole therethrough, and a spring;

wherein the spring-loaded cord lock is made of plastic material;

the toggle is attached into the bead opening along with the spring;

wherein all the holes are aligned when the toggle is pressed, and to secure the hair tie the nub is housed completely inside the aligned holes of the bead;

the distal end of the elastic cord holds in place inside the bead when the toggle is released trapping the nub inside the bead;

wherein the hair tie is secured to a ponytail, and

Wherein the hair tie is released from the ponytail by pressing a button to release the nub from the spring-loaded cord-lock.

* * * * *